United States Patent [19]

Bond et al.

[11] Patent Number: 5,072,466

[45] Date of Patent: Dec. 17, 1991

[54] LINER FOR A SLEEPING BAG

[76] Inventors: Larry D. Bond; Donna M. Bond, both of 3811 44 Street South West, Calgary, Alberta, Canada, T3E 3S4

[21] Appl. No.: 543,039

[22] Filed: Jun. 25, 1990

[51] Int. Cl.[5] ..... A47G 9/08

[52] U.S. Cl. ..... 5/413; 2/69.5

[58] Field of Search ..... 5/413, 482; 2/69.5, 2/69

[56] References Cited

U.S. PATENT DOCUMENTS 2,972,757 2/1961 Adrian ..... 5/413

3,564,629 2/1971 Rogius ..... 5/413

4,339,835 7/1982 Zaffe et al. ..... 5/413

*Primary Examiner*—Alexander Grosz

*Attorney, Agent, or Firm*—Adrian D. Battison; Stanley G. Ade; Murray E. Thrift

[57] ABSTRACT

A sleeping bag and liner combination comprises a conventional sleeping bag, and a liner adapted to be inserted within said sleeping bag. The liner is made from two overlying sheet portions and has at one of its lower corners a member having a narrow neck for projecting through a narrow opening in a corner portion of the sleeping bag, and a head portion wider than the neck to retain the head portion outside the sleeping bag.

10 Claims, 2 Drawing Sheets

LINER FOR A SLEEPING BAG

BACKGROUND OF THE INVENTION

The invention relates to a liner for a sleeping bag.

Conventionally a sleeping bag includes a fabric bag formed from two overlying sheet portions of an insulated fabric material with a zipper which extends down one side of the bag and across the bottom of the bag. Sleeping bags of this type are of course widely used but suffer from the disadvantages that firstly the zipper is exposed on the inner surface of the bag and hence can contact the body of the user and secondly once the inner surface of the bag becomes soiled by extensive use it is necessary to wash the whole of the bag rather than any form of separate liner. As the bag filled with an insulation material this is more difficult and leads to extensive wear of the bag causing premature replacement.

SUMMARY OF THE INVENTION

It is one object of the present invention, therefore, to provide an improved liner for a sleeping bag which remains properly located in the bag but can readily be removed for washing.

According to the first aspect of the invention, therefore, there is provided a liner for a sleeping bag comprising substantially rectangular liner bag formed from two overlying sheet portions of a fabric material stitched together to define a closed lower end of the liner bag, two sides of the liner bag and an open mouth of the liner bag, one corner of the liner bag defined at the junction between the lower end and one side having projecting therefrom a member having a narrow neck for projecting through a narrow opening in the sleeping bag and a head portion wider than the neck to retain the head portion outside the sleeping bag.

According to a second aspect of the invention, therefore, there is provided sleeping bag and liner combination comprising a sleeping bag formed from two overlying sheet portions of an insulated fabric material including a zipper extending from one lower corner of the sleeping bag across a lower end of the sleeping bag and up one side of the sleeping bag to an open mouth of the sleeping bag, the liner comprising a substantially rectangular liner bag formed from two overlying sheet portions of a fabric material stitched together to define a closed lower end of the liner bag, two sides of the liner bag and an open mouth of the liner bag, one corner of the liner bag defining a junction between the lower end and one side having projecting therefrom a member having a narrow neck projecting through a narrow opening at the end of the zipper of the sleeping bag and a head portion wider than the neck to retain the head portion outside of the sleeping bag so as to locate the liner bag within the sleeping bag.

Preferably the projecting member comprises a soft pom pom which is stitched to the lower corner of the liner bag. This pom pom acts to locate the bottom corner of the liner bag at the bottom corner of the sleeping bag and also closes the hole at the lower end of the sleeping bag to reduce the possibility of any draft.

Preferably the liner bag includes a slit at the upper edge of one side of the bag so as to allow the bag to be entered more easily and to be movable around the body of the user. Preferably the slit is on the same side as the pom pom that is the side opposite to the zipper to prevent the zipper contacting the body of the user.

The pom pom can be distinctively coloured to enable it to act as identification device for the sleeping bag. Thus different users could have different colour pom poms to identify what could be otherwise identical sleeping bag for use by a particular person.

The bag liner acts as a sheet for the sleeping bag thus reducing dry cleaning costs and wear of the sleeping bag.

The slit allows for movement inside the sleeping bag with the zipper of the sleeping bag partially open without having the skin of the user exposed.

The liner can in some cases provide an additional insulation value for the sleeping bag.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
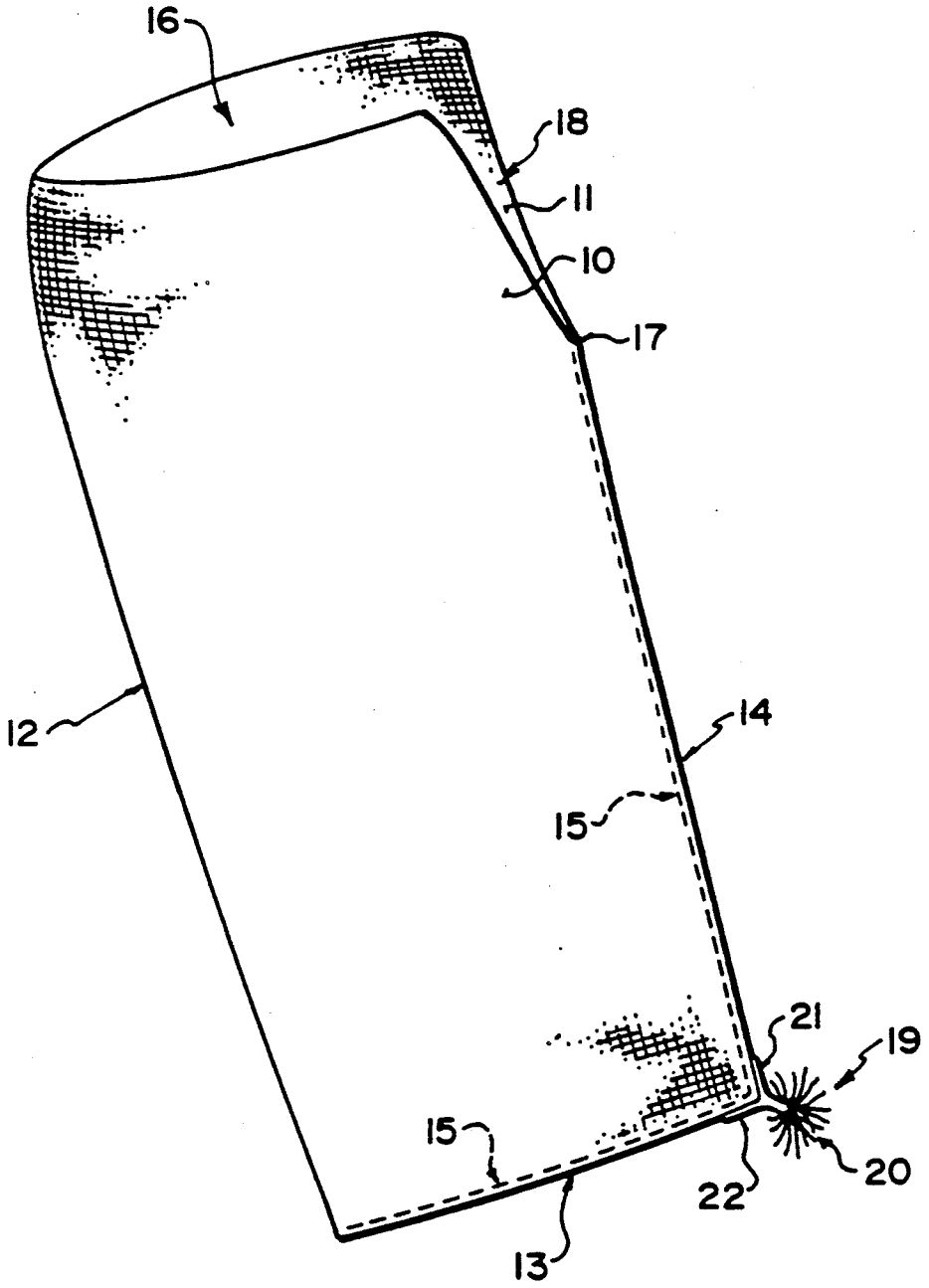
FIG. 1 is an isometric view of a sleeping bag liner according to the invention.

The liner in FIG. 1 comprises a bag formed from fabric material defined by two overlying sheet portions 10 and 11 folded along one side edge 12 and stitched along a bottom edge 13 and one side edge 14 as indicated in a dashed-stitch line 15 to form a bag having two closed sides, a closed lower end and an open mouth 16.

The side 14 is stitched only to a point 17 spaced from the open mouth 16 to leave a slit 18 along a length of the order of 12 to 18 inches in comparison with the full length of the side which would be of the order of five feet to six feet.

Figure 3:
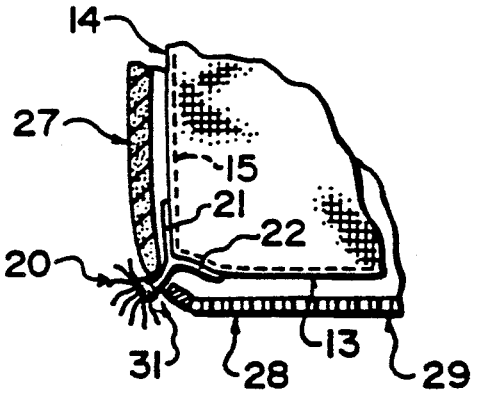
FIG. 3 is a cross-sectional view through one corner of the bag and liner combination of FIG. 2.

At one lower corner of the bag which is the corner at the bottom of the stitched side 14 is attached a projecting member 19 formed as a fluffy pom pom construction 20 mounted upon a pair of strings 21 and 22 stitched to the lower corner of the bag as best shown in FIG. 3. The pom pom is of conventional construction formed from a plurality of yarns extending outwardly from a central core defined by the strings 21 and 22 so that the pom can be permanently attached to the lower corner and project outwardly therefrom with the strings acting as a narrow neck portion.

Figure 2:
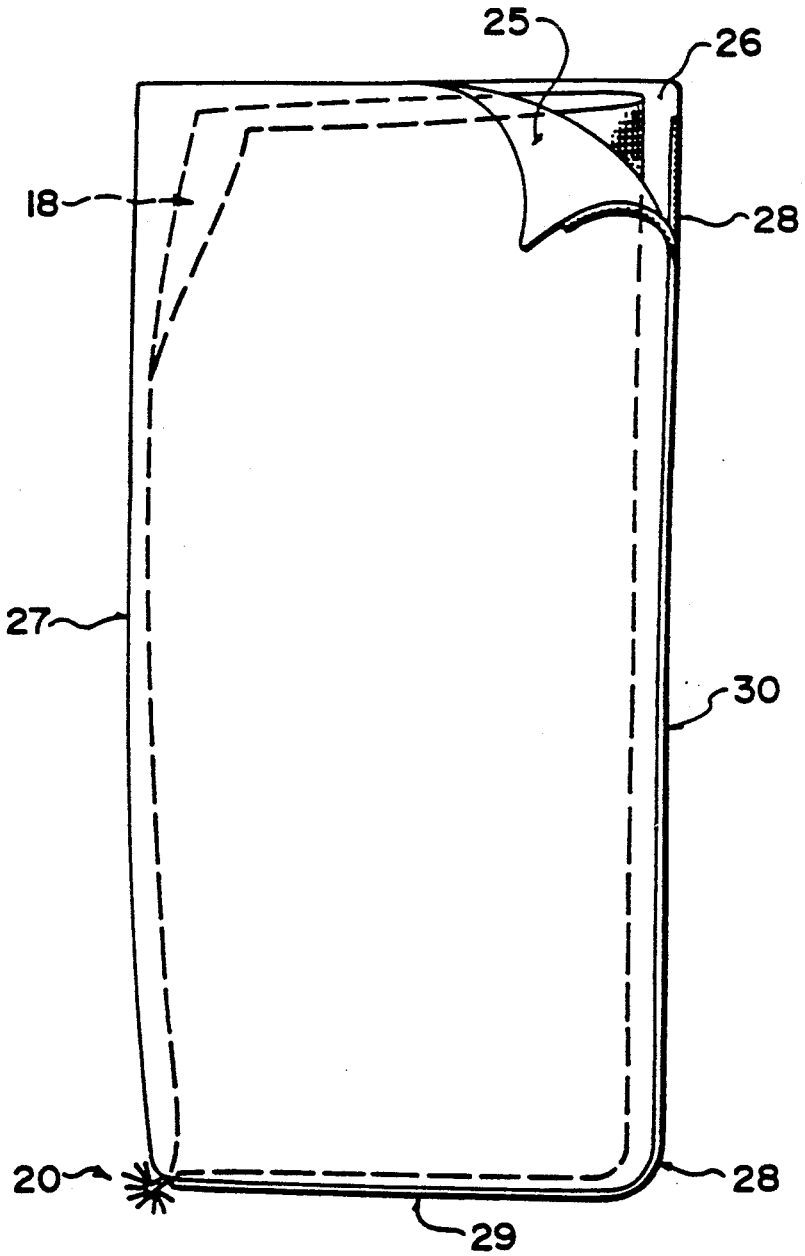
FIG. 2 is a top plan view of a sleeping bag including the liner according to the present invention.

A conventional sleeping bag is shown in FIG. 2 and includes two sheet portions 25 and 26 which are folded along one side 27 with a zipper 28 extending across a bottom edge 29 and along the opposed side edge 30 to close the bag apart from the upper open mouth. The end of the zipper 28 at the bottom left hand corner of the bag leaves a narrow hole 31. In operation the liner is inserted into the bag and the neck of the pom pom pass through the opening 31 so that the pom pom lies on the outside of the sleeping bag and is held thereby that it cannot pass through the narrow opening 31. The liner is therefore located in place and the tendancy of the liner to pull away from the corner of the bag causes the pom pom to be pulled into the opening 31 to fully close the opening 31.

The slit 18 is originally on the same side as the pom pom and accordingly is located on the opposite side to the zipper 28 as shown on the top of the bag in FIG. 2. Thus the user of the bag is relatively free to move inside the liner and inside the zipper but the zipper is held away from the skin of the user.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A liner for a sleeping bag comprising substantially rectangular liner bag formed from two overlying sheet portions of a fabric material stitched together to define a closed lower end of the liner bag, two sides of the liner bag and an open mouth of the liner bag, one corner of the liner bag defined at the junction between the lower end and one side having projecting therefrom a member having a narrow neck for projecting through a narrow opening in the sleeping bag and a head portion wider than the neck to retain the head portion outside the sleeping bag

2. The liner according to claim 1 wherein the projecting member comprises a pom pom.

3. The liner according to claim 2 wherein the pom pom is distinctively colored.

4. The liner according to claim 1 wherein one side of the fabric bag has a slit at the top thereof intersecting with the open mouth.

5. The liner according to claim 4 wherein the slit is on the same side as the projecting member.

6. A sleeping bag and liner combination comprising a sleeping bag formed from two overlying sheet portions of an insulated fabric material including a zipper extending from one lower corner of the sleeping bag across a lower end of the sleeping bag and up one side of the sleeping bag to an open mouth of the sleeping bag, the liner comprising a substantially rectangular liner bag formed from two overlying sheet portions of a fabric material stitched together to define a closed lower end of the liner bag, two sides of the liner bag and an open mouth of the liner bag, one corner of the liner bag defining a junction between the lower end and one side having projecting therefrom a member having a narrow neck projecting through a narrow opening at the end of the zipper of the sleeping bag and a head portion wider than the neck to retain the head portion outside of the sleeping bag so as to locate the liner bag within the sleeping bag.

7. The liner according to claim 6 wherein the projecting member comprises a pom pom.

8. The liner according to claim 7 wherein the pom pom is distinctively colored.

9. The liner according to claim 6 wherein one side of the fabric bag has a slit at the top thereof intersecting with the open mouth.

10. The liner according to claim 9 wherein the slit is on the same side as the projecting member.

* * * * *